US006942581B2

(12) United States Patent
Kim et al.

(10) Patent No.: US 6,942,581 B2
(45) Date of Patent: Sep. 13, 2005

(54) GOLF CLUB HEAD

(76) Inventors: Tae-Joon Kim, 6218 S. Netherland Cir., Aurora, CO (US) 80016; Richard S. J. Kim, 6516 S. Riviera Wy., Aurora, CO (US) 80016

( * ) Notice: Subject to any disclaimer, the term of this patent is extended or adjusted under 35 U.S.C. 154(b) by 0 days.

(21) Appl. No.: 10/454,546

(22) Filed: Jun. 5, 2003

(65) Prior Publication Data

US 2004/0248666 A1 Dec. 9, 2004

(51) Int. Cl.[7] ..... A63B 53/04
(52) U.S. Cl. ..... 473/345; 473/349; 473/350
(58) Field of Search ..... 473/324, 349, 473/327, 350, 328, 345, 346

(56) References Cited

U.S. PATENT DOCUMENTS

| | | | | |
|---|---|---|---|---|
| 1,064,916 A | | 6/1913 | Kelly et al. | |
| 1,139,985 A | * | 5/1915 | Legh | 473/350 |
| 1,671,956 A | * | 5/1928 | Sime | 473/329 |
| 1,916,792 A | * | 7/1933 | Hadden | 473/324 |
| 3,625,518 A | | 12/1971 | Solheim | |
| 3,640,534 A | | 2/1972 | Mills | |
| D240,948 S | * | 8/1976 | Redoutey | D21/747 |
| 5,060,949 A | * | 10/1991 | Brill | 473/328 |
| 5,078,400 A | * | 1/1992 | Desbiolles et al. | 473/349 |
| 5,098,103 A | | 3/1992 | MacKeil | |
| 5,186,465 A | * | 2/1993 | Chorne | 473/350 |
| 5,203,565 A | * | 4/1993 | Murray et al. | 473/242 |
| 5,547,426 A | * | 8/1996 | Wood | 473/290 |
| 6,458,042 B1 | * | 10/2002 | Chen | 473/327 |

OTHER PUBLICATIONS

"Physics Principles with Applications," Giancoli, Douglas, California State Polytechnic University.

Noslice.com webpage, Jan. 26, 2001.

* cited by examiner

*Primary Examiner*—Sebastiano Passaniti
(74) *Attorney, Agent, or Firm*—Browdy and Neimark, P.L.L.C.

(57) ABSTRACT

A golf club head composed of a one-piece body having a front side, a rear side, a top and a bottom, and provided with a groove that extends from the rear side to locally reduce the cross-section of the body and to form the body into a heel sub-head adjacent a hosel and a toe sub-heads remote from the hosel, the sub-heads meeting at a joint plane in the body, the joint plane extending from the base of the groove to the front side.

12 Claims, 8 Drawing Sheets

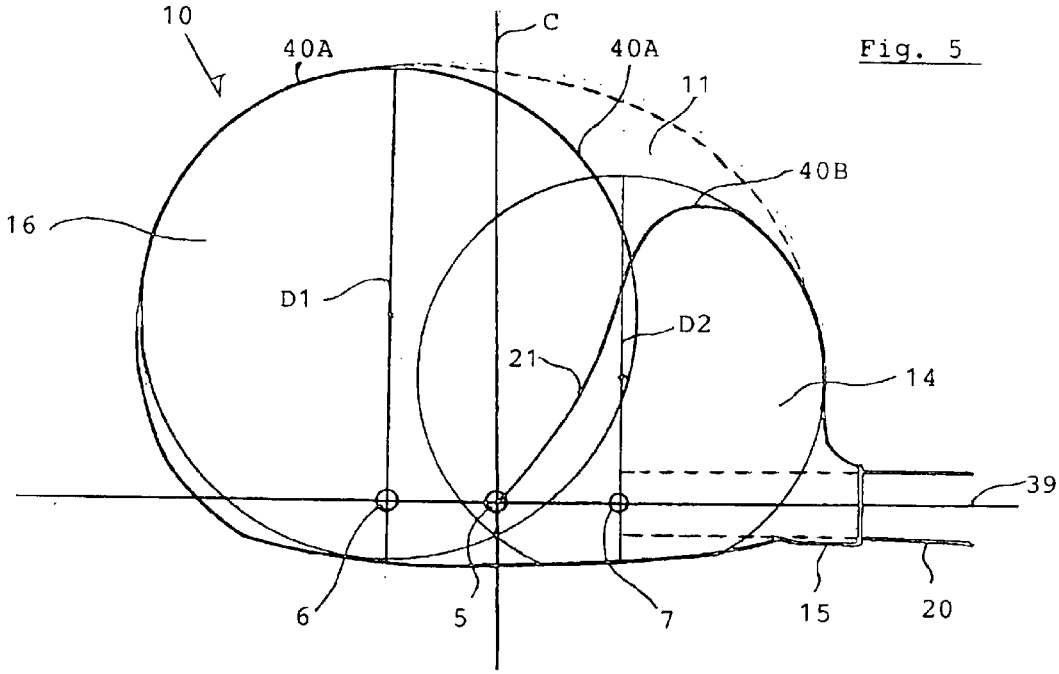
Fig. 5
Fig. 6
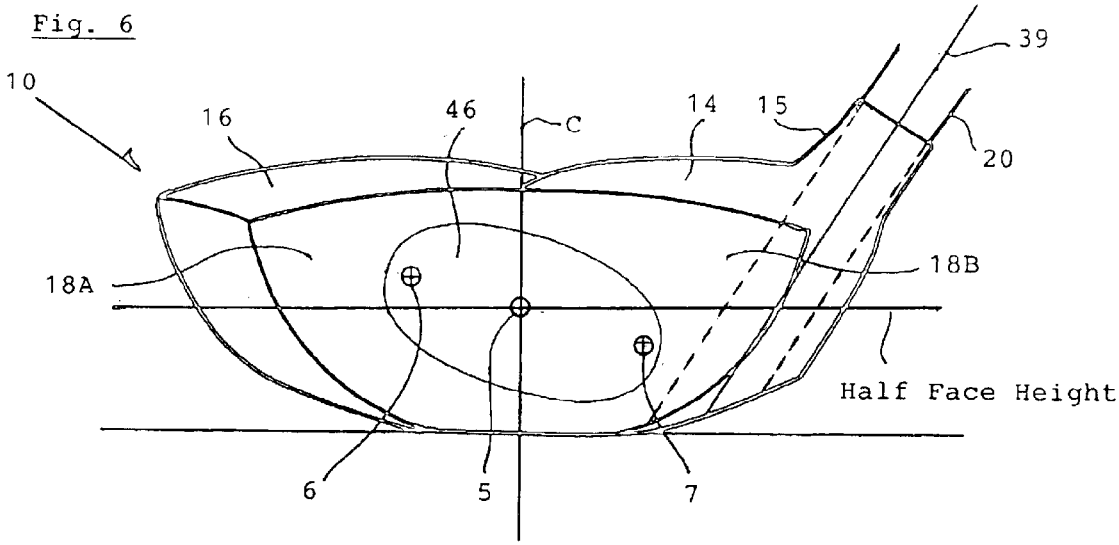

GOLF CLUB HEAD

BACKGROUND OF THE INVENTION

The present invention relates to golf club heads.

It is known that the flight of a golf ball can be controlled most accurately by striking the ball at the center of gravity, or at the sweet spot, which is an area of the club head face that surrounds the center of gravity and has an extent that varies from one club head design to another.

In the prior art it is known to increase the area of the sweet spot by increasing the volume and weight of the club head However, this, in turn, increases its air resistance, or drag force, and thus reduces the speed at which it can strike the ball.

In addition, because the shaft of a club forms an obtuse angle with the length dimension of the club head, the head is twisted by a hinge action if the ball is struck at a point above or below the center of gravity, or the sweet spot, resulting in a hook or slice.

BRIEF SUMMARY OF THE INVENTION

The present invention provides a novel golf club head that is given an enlarged sweet spot without a corresponding increase in volume and weight and consequent increased drag force.

A golf club head according to the invention comprises: a one-piece body having a front side, a rear side, a top and a bottom, and provided with a groove that extends from the rear side to locally reduce the cross-section of the body and to form the body into a heel sub-head adjacent a hosel and a toe sub-head remote from the hosel, the sub-heads meeting at a joint plane in the body, the joint plane extending from the base of the groove to the front side.

Thus, the golf club head according to the invention is made up of two sub-heads that create several centers of gravity that are spaced apart in the general direction of the length dimension, resulting in a significantly enlarged sweet spot.

BRIEF DESCRIPTION OF DRAWINGS

FIGS. 5 and 6 are views similar to those of FIGS. 3 and 4 of the first preferred embodiment, with reference circles and lines added to illustrate certain features of the club head.

DETAILED DESCRIPTION OF THE INVENTION

A first preferred embodiment of a golf club head according to the invention is shown in FIGS. 1–15.

The first preferred embodiment of the invention is a driver club head for a club that is typically known as a "wood" because club heads of this type were historically made of that material. However, clubs known as "woods" may now be made of other materials, such as fiberglass, carbon fiber, ceramic fiber reinforced plastic, or other materials, including materials that may be developed and adopted for this purpose in the future, and all of these materials are intended to be encompassed by the present invention.

Figure 1:
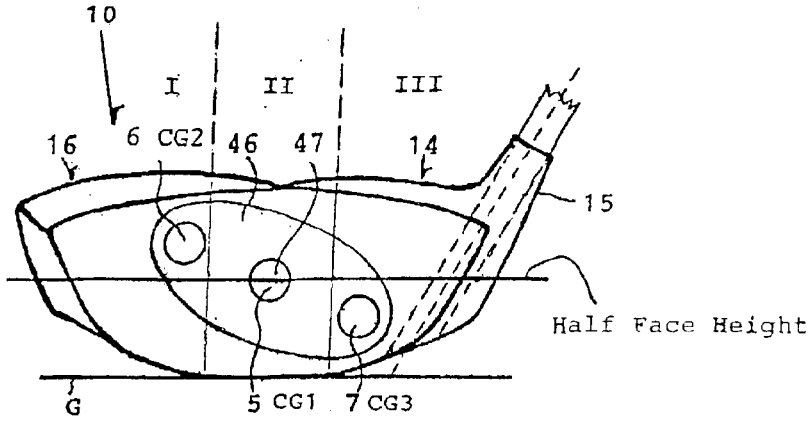
FIG. 1 is a front elevational view of a first preferred embodiment of a golf club head according to the invention.
Figure 2:
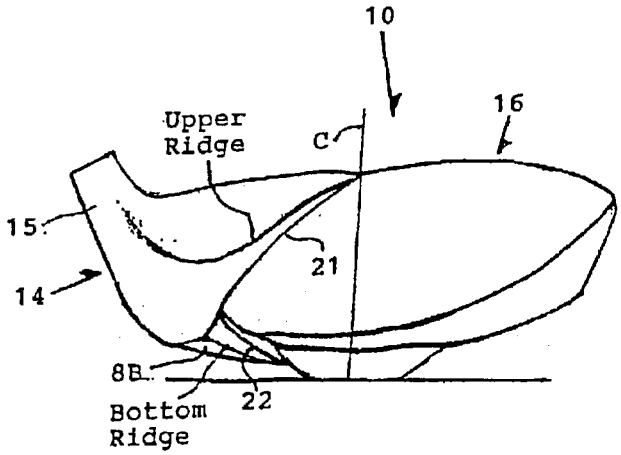
FIG. 2 is a perspective view, from the rear and side, of the head of FIG. 1.

Referring specifically to FIG. 1, a club head can be considered to be divided into three regions: a toe region I; a center region II; and a heel region III. Known golf club heads exhibit one center of gravity 5 essentially at the center of region II, with an associated sweet spot that may have the shape and size indicated by area 47. The vast majority of strokes by an average golfer will involve impact with the ball at some point in a larger area 46, which extends into regions I and III.

The club head 10 according to the invention is configured, as will be described in detail below, to have a heel sub-head 14 corresponding to region III and a toe sub-head 16 corresponding to regions I and II and behaves as if it has three centers of gravity 5, 6, and 7, each in a respective one of regions I, II and III, with a resulting greatly enlarged sweet spot 46 that covers a substantial portion of the front, or striking, face of the club head.

Reference will now be made to FIGS. 1-15 as a group.

Club head 10, which is formed essentially of two sub-heads, heel sub-head 14 adjacent a hosel 15 and toe sub-head 16 remote from hosel 15, is a one-piece body provided at its rear side, which is the trailing side during a forward swing of the golf club, with a groove that divides the club head into sub-heads 14 and 16, which meet at a joint plane 21.

Figure 13:
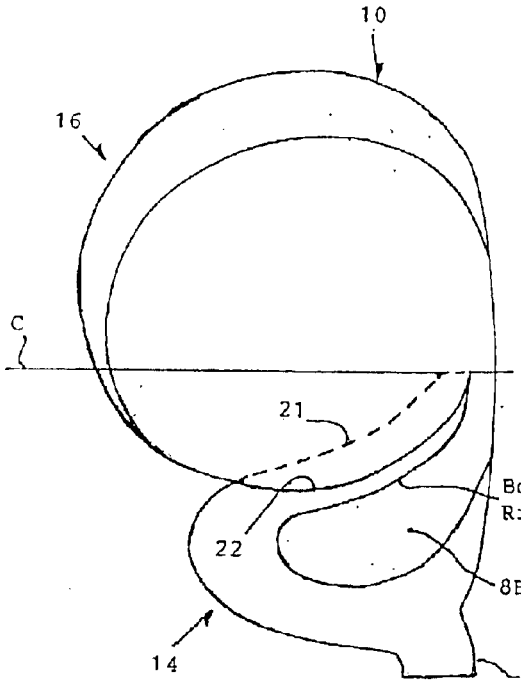
FIGS. 13 and 14 are, respectively, a bottom plan view and a top plan view showing the configuration of the club head in greater detail.
Figure 14:
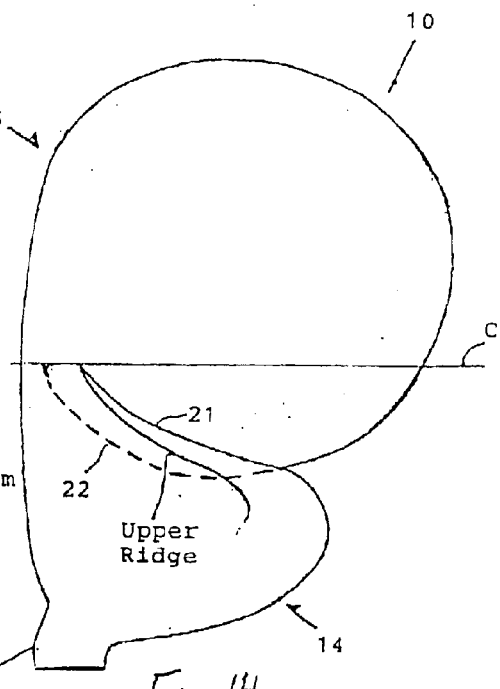
Figure 15:
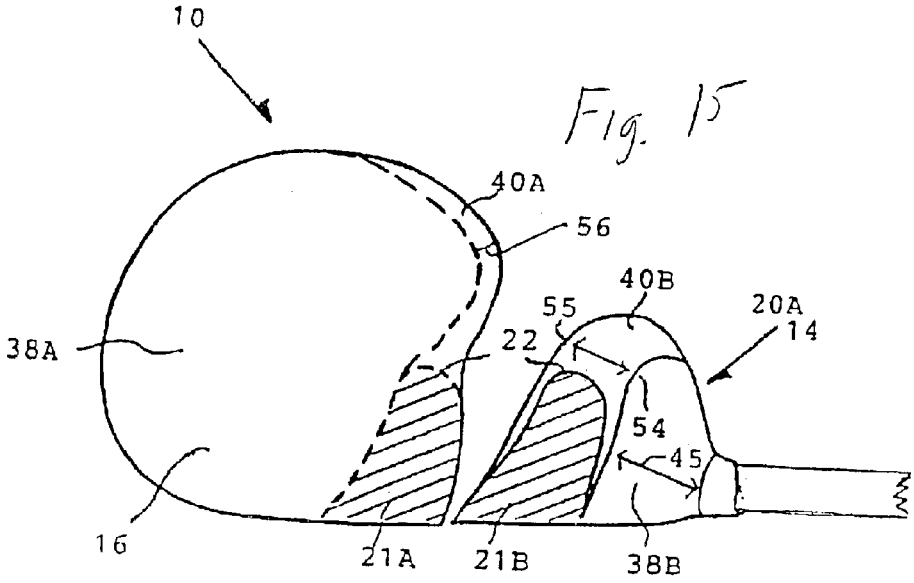
FIG. 15 is an exploded view showing two sections of the club head rotated relative to one another from their actual spatial relation.

FIGS. 13 and 14 show most clearly the configuration of the top and bottom surfaces of club head 10. FIG. 15 shows sub-heads 14 and 16 separated from one another to more clearly illustrate the form of joint plane 21, which is designated 21A at the side associated with sub-head 16 and 21B at the side associated with sub-head 14. Club head 10 consists, in fact, of a single piece of material that extends continuously across joint plane 21. In other words, FIG. 15 shows how the sub-heads would appear if head 10 were cut apart along joint plane 21. Joint plane 21 extends from the bottom 22 of the groove to the front side of club head 10.

Sub-head 16 has a bottom surface, or sole portion, 8A, a front surface, or striking face, 18A, a top surface 38A and a rear surface 40A. Sub-head 14 has corresponding surfaces 8B, 18B, 38B and 40B.

The joint plane 21A,B acts as a secondary neck of golf club 10.

A significant feature of club head 10 is that it has three distinct centers of gravity: 5 (CG1) provided by the entire club head; 6 (CG2) provided by toe sub-head 16; and 7 (CG3) provided by heel sub-head 14. Preferably CG1, 2 and 3 are located on a common line that is inclined downwardly toward the heel of the club head, but the centers of gravity can be present in other patterns. In either case, the three centers of gravity result in a relatively large sweet spot for a club head having normal exterior dimensions. The line C in FIGS. 2, 5, 6, 13 and 14 passes through what would be the center of a conventional golf club head having overall dimensions comparable to an embodiment of the present invention.

FIGS. 3, 4 and 7–12C show one set of exemplary dimensional values for the first preferred embodiment of a club head according to the invention. The longitudinal, or length, direction and the width, or thickness, direction of the club head correspond to the horizontal and vertical directions, respectively, of FIG. 3, while the longitudinal and height directions of the head correspond to he horizontal and vertical directions, respectively, of FIG. 4.

Figure 3:
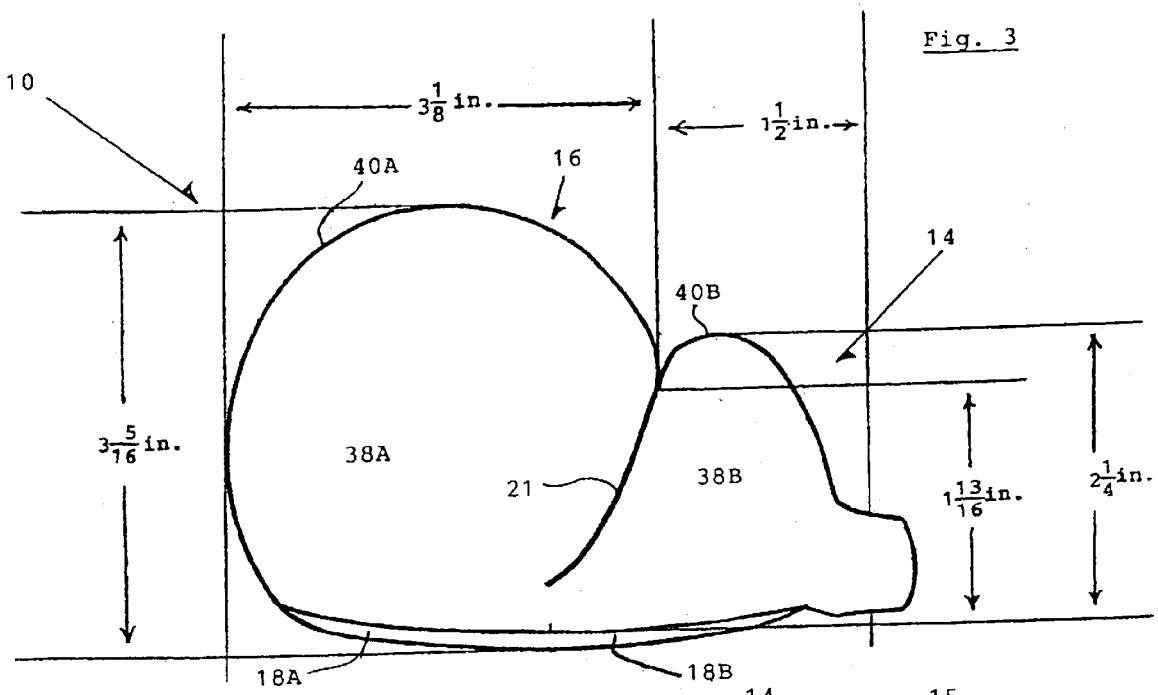
FIGS. 3 and 4 are, respectively a top plan view and a front elevational view of the head of FIG. 1, showing exemplary linear dimensions of the first preferred embodiment.
Figure 4:
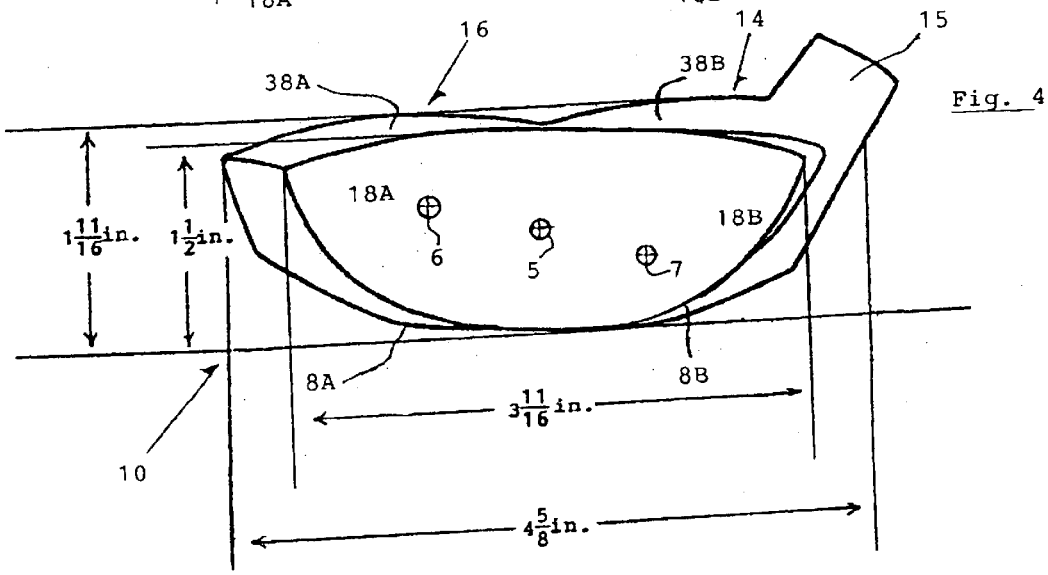
Figure 7:
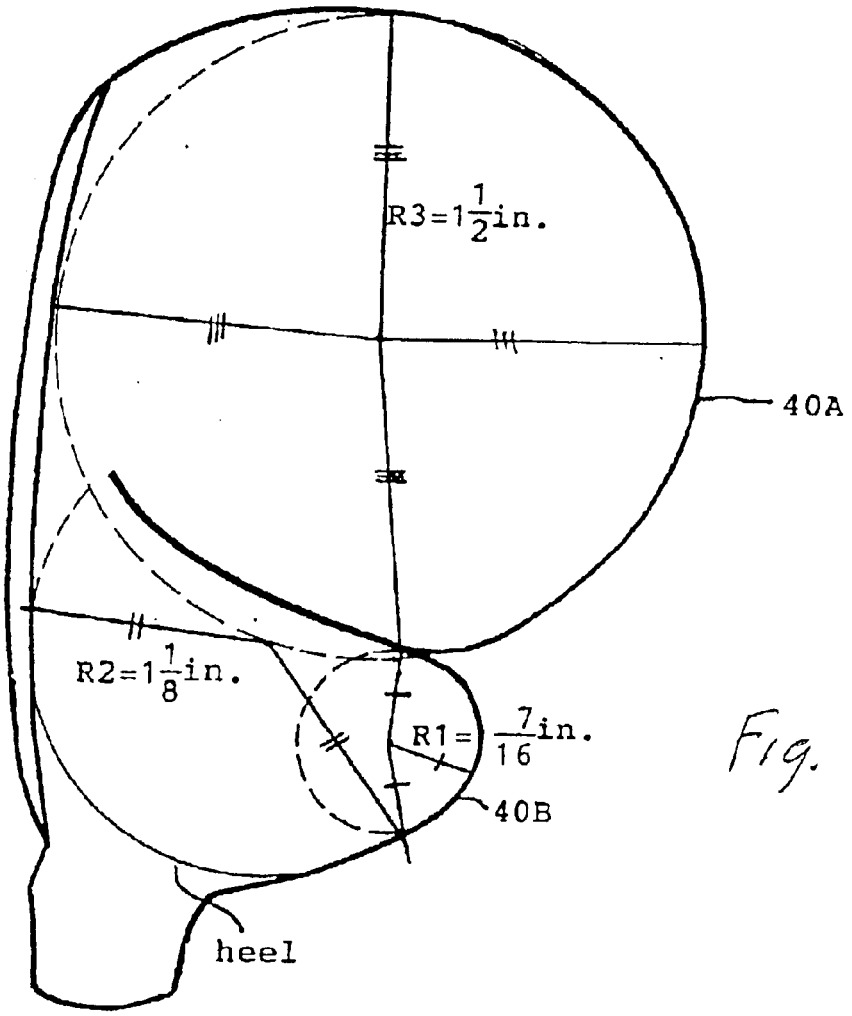
FIG. 7 is a top plan view if the head of FIG. 1, showing exemplary radius of curvature dimensions of the first preferred embodiment in a horizontal plane.
Figure 8A:
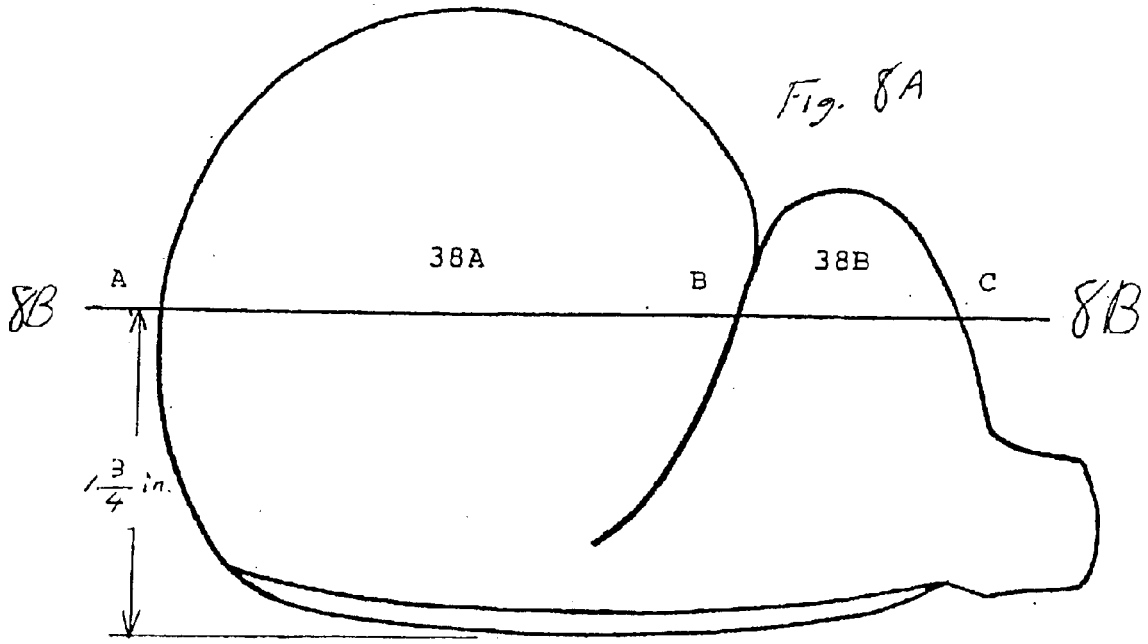
FIG. 8A is a top plan view of the head of FIG. 1, with a cross section line 8B—8B in the longitudinal direction of the head.
Figure 8B:
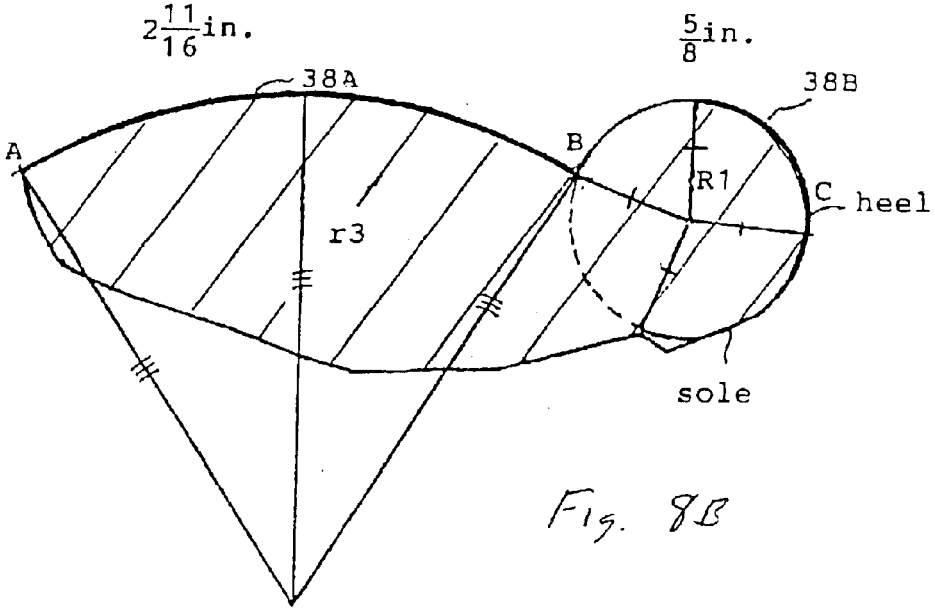
FIG. 8B is an elevational cross-sectional view along line 8B—8B of FIG. 8A, showing exemplary radius of curvature dimensions of the first preferred embodiment.
Figure 9A:
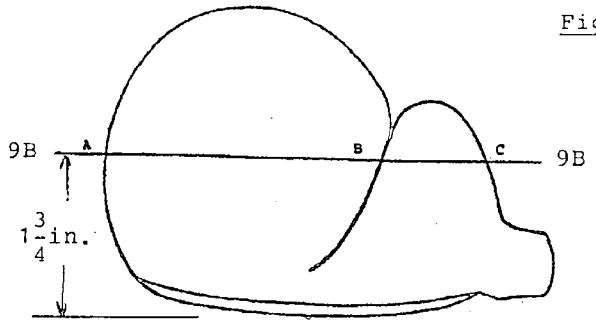
FIGS. 9A, 10A and 11A are top plan views of the head of FIG. 1, each with a respective cross-section line 9B—9B, 10B—10B, 11B—11B.
Figure 9B:
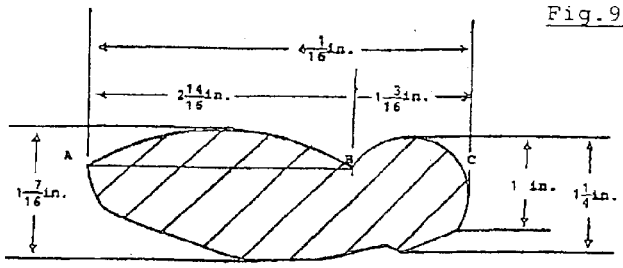
FIGS. 9B, 10B and 11B are elevational cross-sectional views along lines 9B—9B, 10B—10B and 11B—11B, respectively, showing exemplary linear dimensions of the first preferred embodiment.
Figure 10A:
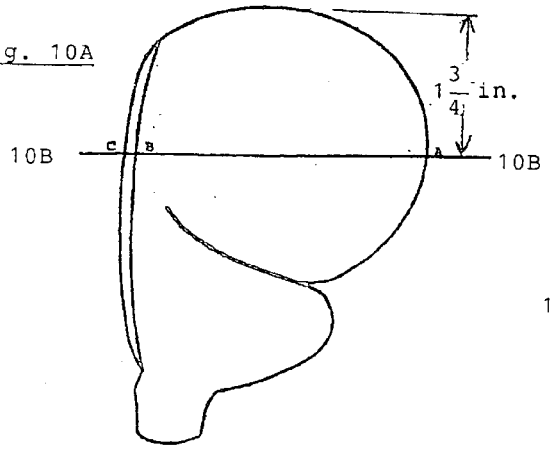
Figure 11A:
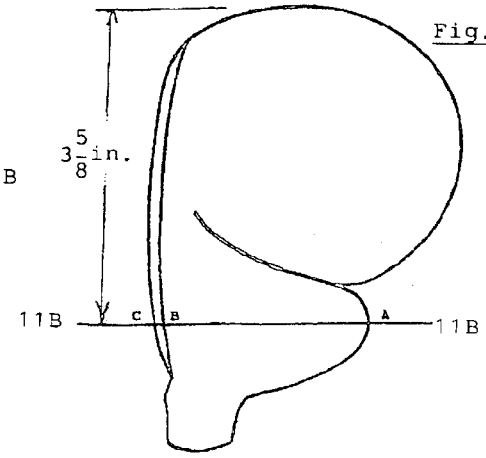
Figure 10B:
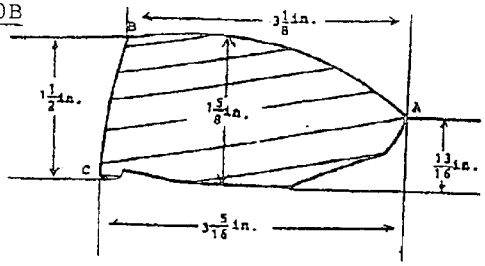
Figure 11B:
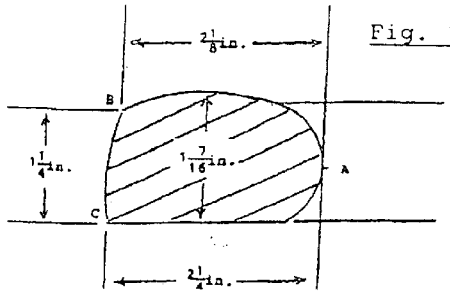
Figure 12B:
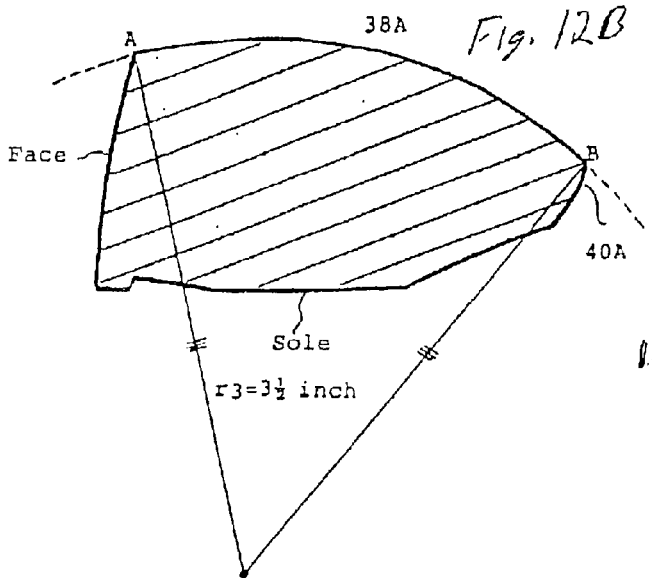
FIGS. 12B and 12C are elevational cross-sectional views along lines 12B—12B and 12C—12C of FIG. 12A, showing exemplary radius dimensions of the first preferred embodiment.
Figure 12A:
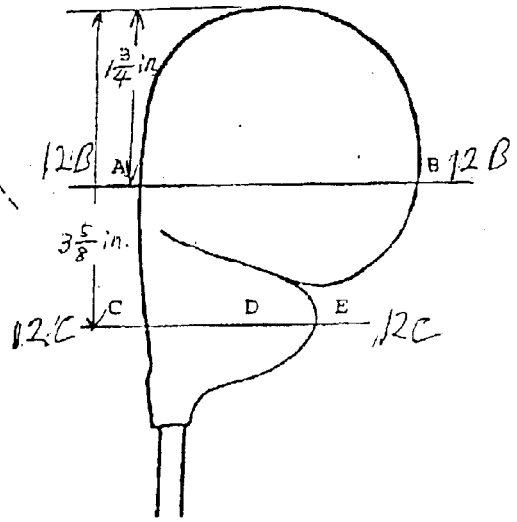
FIG. 12A is a top plan view of the head of FIG. 1, with cross section lines 12B—12B and 12C—12C in the width, or thickness, dimension of the head.
Figure 12C:
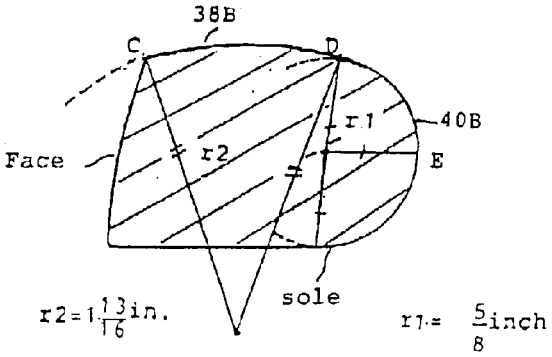

FIGS. 5 and 6 are views identical to those of FIGS. 3 and 4, respectively, and FIG. 5 includes superimposed circles with diameters D1 and D2, which are not structural elements of the club head, but coincide with arcuate portions of the rear surface of the club head. As indicated by the circle whose diameter is represented by line D1, the location of the maximum width dimension of a golf club head according to the invention is shifted toward the toe portion from the center in comparison with convention golf club heads. At the location of maximum width, along the line D1, toe sub-head 16 holds more concentrated perimeter weight. Center of gravity 6 is centered on the intersection of line D1 and a vertical plane containing the axis 39 of shaft 20. A portion 11 represents material that can be removed from a club head blank to form the club head according to the invention. Center of gravity 7 is centered on the intersection of line D2 and the vertical plane containing the axis 39 of shaft 20. Center of gravity 7 is associated with the mass of heel sub-head 14, hosel 15 and a lower part of shaft 20. As a result, the club head according to the invention is composed of masses that have, in effect, shifted toward centers of gravity 6 and 7, with the following advantages: impulsive forces are produced as a result of increased moment of inertia stemming from the concentrated weight masses; and an increased moment of inertia cooperates to increase the resistance of the club head to twisting.

Obviously, these values could be varied within the framework of the invention. Dimensions not indicated can be typical for conventional woods.

Preferably, club head 10 is configured so that heel sub-head 14 contains no more than 40% of the mass of club bead 10 and, correspondingly, toe sub-head 16 contains at least 60% of the club head mass. Also preferably, in the thickness direction of club head 10, the distance between rear surface 38A of toe sub-head 16, at the thickest point of toe sub-head 16, and groove bottom 22 is preferably less than 70% of the maximum thickness of the toe sub-head 16 in the thickness direction. Further preferably, in the longitudinal direction of club head 10, the distance from the heel end of the club head to groove bottom 22 is preferably less than 40% of the total length of the club head in the longitudinal direction.

As illustrated, the top and rear surfaces of each sub-head have convex shapes, which may have the form of spheroidal or spherical segments.

As already noted, the embodiment described above relates to a club head of the "wood" type, such as a driver. Other embodiments of the invention can take the form of other types of club heads, such as those that are made of metal and are commonly referred to as irons. Here again, the invention encompasses any modern materials that are used, or that may be adopted for use in club heads that are commonly referred to in the art as "irons."

Figure 16:
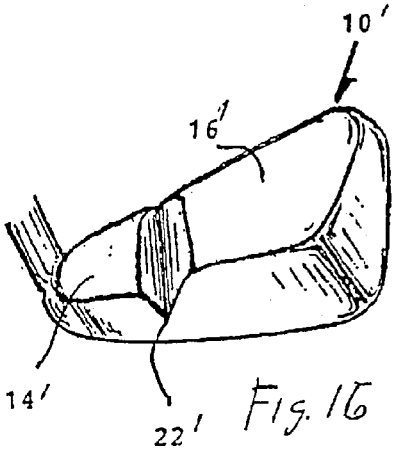
FIGS. 16 and 17 are a perspective view, from the rear and below, and a top plan view of two examples of a second preferred embodiment of a golf club head according to the invention.
Figure 17:
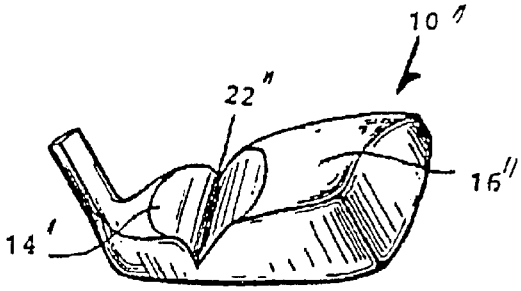

Two examples of club heads 10' and 10" of the latter type are shown in FIGS. 16 and 17. These embodiments also include a groove having a bottom 22', 22", the groove dividing the club head into a heel sub-head 14', 14" and a toe sub-head 16', 16".

In the embodiment of FIG. 16, the rear surfaces of sub-heads 14' and 16' are relatively flat, as is typical of irons, and the outer extremity of the groove has a relatively large dimension in the longitudinal direction of the club head. In the embodiment of FIG. 17, the rear surfaces of sub-heads 14" and 16" are convex in a vertical plane, the groove has convex side walls, and the groove is relatively narrow. In other respects, each club head can have dimensions that are typical for conventional irons.

Of course, embodiments of the invention can have configuration and relative dimension other than those disclosed herein.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A golf club head comprising: a one-piece body having a front side, a rear side, a top and a bottom, wherein said one-piece body is provided with a groove that extends from said rear side to locally reduce the cross-section of said body and to form said body into a heel sub-head adjacent a hosel and a toe sub-head remote from the hosel, the sub-heads meeting at a joint plane in said body, which joint plane extends from the base of said groove to said front side, and further wherein said golf club head has a center of gravity and said toe sub-head is dimensioned such that a line passing through the center of gravity and perpendicular to said front side intersects said toe sub-head.

2. The club head of claim 1 wherein each of said front and rear sides is composed of a heel sub-head part and a toe sub-head part, and said heel and toe sub-head parts of said front sides are substantially coplanar.

3. The club head of claim 2 wherein said heel and toe sub-head parts are each essentially convex at said rear side.

4. The club head of claim 3 wherein said convex heel and toe sub-head parts at said rear side are each defined by a circular arc in at least one plane.

5. The club head of claim 3 wherein said convex heel and toe sub-head parts at said rear surface are each defined by circular arcs in two mutually perpendicular planes.

6. The club head of claim 3 wherein said body is made of wood.

7. The club head of claim 1 wherein the base of said groove has outline that is convex in a direction away from said front side.

8. The club head of claim 1 wherein said body is made of metal.

9. The club head of claim 1 wherein said toe sub-head contains at least 60% of the mass of said golf club head.

10. The golf club head of claim 1 wherein club head has a height dimension between said top and bottom and said groove locally reduces the height dimension of said club between said heel and toe sub-heads.

11. A golf club head comprising: a one-piece body having a front side, a rear side, a top and a bottom, wherein said one-piece body is provided with a groove that extends from said rear side to locally reduce the cross-section of said body and to form said body into a heel sub-head adjacent a hosel and a toe sub-head remote from the hosel, the sub-heads meeting at a joint plane in said body, which joint plane extends from the base of said groove to said front side, and further wherein said toe sub-head contains at least 60% of the mass of said golf club head.

12. The golf club head of claim 11 wherein said club head has a height dimension between said top and bottom and said groove locally reduces the height dimension of said club between said heel and toe sub-heads.

* * * * *